US010655790B2

(12) United States Patent
Kaandorp et al.

(10) Patent No.: US 10,655,790 B2
(45) Date of Patent: May 19, 2020

(54) LIGHTING DEVICE

(71) Applicant: SIGNIFY HOLDING B.V., Eindhoven (NL)

(72) Inventors: Wouter Petrus Kaandorp, Eindhoven (NL); Coen Theodorus Hubertus Fransiscus Liedenbaum, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/115,060

(22) PCT Filed: Jan. 20, 2015

(86) PCT No.: PCT/EP2015/050914
§ 371 (c)(1),
(2) Date: Jul. 28, 2016

(87) PCT Pub. No.: WO2015/113852
PCT Pub. Date: Aug. 6, 2015

(65) Prior Publication Data

US 2016/0348852 A1 Dec. 1, 2016

(30) Foreign Application Priority Data

Jan. 30, 2014 (EP) ..... 14153167

(51) Int. Cl.
*F21K 9/232* (2016.01)
*F21V 13/04* (2006.01)
(Continued)

(52) U.S. Cl.
CPC ..... *F21K 9/232* (2016.08); *F21K 9/235* (2016.08); *F21K 9/237* (2016.08); *F21K 9/238* (2016.08);
(Continued)

(58) Field of Classification Search
CPC ..... F21K 9/232; F21K 9/237; F21V 13/04; F21V 23/005; F21L 14/026
See application file for complete search history.

(56) References Cited

U.S. PATENT DOCUMENTS 3,586,851 A * 6/1971 Rudolph ..... F21V 9/00 362/293
3,610,912 A * 10/1971 Schwartz ..... B64F 1/205 362/261
(Continued)

FOREIGN PATENT DOCUMENTS

DE 20018435 U1 2/2001
EP 2636942 A1 9/2013
(Continued)

*Primary Examiner* — Jong-Suk (James) Lee
*Assistant Examiner* — Christopher E Dunay
(74) *Attorney, Agent, or Firm* — Akarsh P. Belagodu

(57) ABSTRACT

A lighting device (1, 11, 21) comprising a substrate (4, 14, 24), a plurality of light sources (3, 13, 23), and a housing (2, 12, 22) of a light transmissive material. The substrate has a first side (4*a*, 14*a*, 24*a*) and a second side (4*b*, 14*b*, 24*b*) and the plurality of light sources are arranged on the first side of the substrate. The light sources have a common general output direction. The housing is arranged to transmit light surrounding the substrate, having a first portion (2*a*, 12*a*, 22*a*) of said housing and a second portion (2*b*, 12*b*, 23*b*) of the housing arranged substantially opposite the first portion with respect to the substrate. The plurality of first optical elements (6, 16, 26) may be arranged substantially opposite the output direction of the plurality of light sources along the first portion of the housing facing the first side of the substrate. The substrate is adapted to allow transmission of light. The plurality of first optical elements are arranged to transmit part of the light emitted by the light sources and reflect part of the light emitted by the light sources through the substrate towards the second portion of the housing.

15 Claims, 3 Drawing Sheets

(51) Int. Cl.

| | |
|---|---|
| ***F21V 3/02*** | (2006.01) |
| ***F21V 23/00*** | (2015.01) |
| ***F21K 9/238*** | (2016.01) |
| ***F21K 9/235*** | (2016.01) |
| ***F21K 9/237*** | (2016.01) |
| ***F21V 3/04*** | (2018.01) |
| ***F21V 5/04*** | (2006.01) |
| ***F21V 7/22*** | (2018.01) |
| ***F21V 19/00*** | (2006.01) |
| ***F21V 23/02*** | (2006.01) |
| *F21V 7/00* | (2006.01) |
| *F21V 5/00* | (2018.01) |
| *F21Y 115/10* | (2016.01) |

(52) U.S. Cl.

CPC ..... *F21V 3/02* (2013.01); *F21V 3/04* (2013.01); *F21V 5/04* (2013.01); *F21V 7/22* (2013.01); *F21V 13/04* (2013.01); *F21V 19/003* (2013.01); *F21V 19/006* (2013.01); *F21V 23/003* (2013.01); *F21V 23/005* (2013.01); *F21V 23/02* (2013.01); *F21V 5/007* (2013.01); *F21V 7/0016* (2013.01); *F21Y 2115/10* (2016.08)

(56) References Cited

U.S. PATENT DOCUMENTS 5,947,588 A * 9/1999 Huang ..... B60Q 1/2696 362/235
6,523,978 B1 2/2003 Huang
8,324,790 B1 * 12/2012 Hu ..... F21V 3/02 313/110
2003/0031015 A1 * 2/2003 Ishibashi ..... F21V 3/00 362/235
2005/0030960 A1 * 2/2005 Sumida ..... G02B 6/0031 370/402
2005/0162864 A1 * 7/2005 Verdes ..... F21V 3/00 362/555
2007/0139949 A1 * 6/2007 Tanda ..... F21K 9/235 362/551
2009/0290334 A1 * 11/2009 Ivey ..... F21V 23/06 362/219
2009/0323342 A1 * 12/2009 Liu ..... F21K 9/00 362/249.02
2011/0235318 A1 * 9/2011 Simon ..... F21S 4/008 362/217.05
2012/0281388 A1 * 11/2012 Cai ..... H01L 25/0753 362/84
2012/0300430 A1 * 11/2012 Kawashima ..... H01L 33/504 362/84
2013/0147348 A1 * 6/2013 Motoya ..... H01L 25/0753 313/512
2013/0187528 A1 * 7/2013 Bailey ..... F21V 13/04 313/46
2013/0200410 A1 8/2013 Kim et al.
2013/0271989 A1 10/2013 Hussel et al.
2014/0168978 A1 * 6/2014 Hu ..... F21V 23/002 362/249.02

FOREIGN PATENT DOCUMENTS

| | | | |
|---|---|---|---|
| JP | 2012084274 | A | 4/2012 |
| JP | 2012104295 | A | 5/2012 |
| KR | 2011070261 | A | 6/2011 |
| WO | WO2012095758 | A2 | 7/2012 |
| WO | 2013043743 | A1 | 3/2013 |

* cited by examiner

LIGHTING DEVICE

CROSS-REFERENCE TO PRIOR APPLICATIONS

This application is the U.S. National Phase application under 35 U.S.C. § 371 of International Application No. PCT/EP2015/050914, filed on Jan. 20, 2015, which claims the benefit of European Patent Application No. 14153167.3, filed on Jan. 30, 2014. These applications are hereby incorporated by reference herein.

FIELD OF THE INVENTION

The present invention generally relates to a lighting device for providing a desired light distribution, and more specifically to cost-efficient lighting device, especially for luminaires and retrofit fittings.

BACKGROUND OF THE INVENTION

Today, the interest in developing and improving alternative lighting devices has greatly increased due to the removal of incandescent light bulbs on the market. This has further lead to increased demands on reduced production costs and to increase the performance of the alternative lighting devices. For example, lighting devices with light emitting diodes have several advantages compared to other conventional lighting, including for example high energy efficiency, high light output and long service life. Therefore, light emitting diodes have also started to be incorporated into lighting devices, replacing the traditional fluorescent lamps and incandescent lamps commonly found in offices, and other general places.

However, the use of light emitting diodes in general lighting is commonly associated with problems relating to unsatisfactory illumination distribution, such as limited output distributions. A large number of light emitting diodes are generally a necessity for providing a lighting device with a desired light distribution transmitting light in a multitude of directions. However, with increasing number of light emitting diodes or light sources high costs inevitably follows as well as increasing the demand on available space for providing efficient placement for accommodating the increasing number of the light sources, leading to decreasing cost efficiency for the lighting device. Furthermore, increasing the number of lighting devices leads to more complicated and complex structures and, thus, places a higher demand on the production process.

A general problem for lighting devices having a substrate protruding from a lamp base is that a plurality of light sources needs to be arranged on the substrate to provide a desired light distribution. Furthermore, to provide more or less omnidirectional lighting both sides of the substrate needs to be arranged with a plurality of light sources leading to high production costs and inefficient production.

However, it would be advantageous to provide a lighting device with an improved illumination distribution through a simple and cost efficient production process.

SUMMARY OF THE INVENTION

It is an object of the present invention to provide a lighting device with improved light distribution with few components for a simple and cost-efficient lighting device in order to at least partly overcome above mentioned problems.

This and other objects are achieved by a lighting device comprising a substrate, a plurality of light sources and a housing. The substrate has a first side and a second side and the plurality of light sources are arranged on the first side of the substrate. The light sources have a common general output direction. The housing of a light transmissive material surrounding the substrate is arranged to transmit light. The housing has a first portion of the housing and a second portion of the housing arranged substantially opposite the first portion with respect to the substrate.

The plurality of first optical elements are arranged substantially opposite the output direction of the plurality of light sources along the first portion of the housing facing the first side of the substrate. The substrate is adapted to allow transmission of light. The plurality of first optical elements is arranged to transmit part of the light emitted by the light sources and reflect part of the light emitted by the light sources through the substrate towards the second portion of the housing. Preferably, the lighting device is arranged to reflect the light that is not transmitted through the first portion of the housing via the substrate towards the second portion of the housing where it will exit the lighting device.

The inventors have realized that by providing a substrate adapted to allow transmission of light and combining the effect of reflection and transmission in an element a cost-efficient lighting device may be produced in a more efficient manner with fewer production steps. Consequently, a lighting device may be provided that allows the light sources to be arranged only on one side of the substrate. The light emitted from the light sources may cover at least a portion of a first half-sphere having the common general output direction. By changing the directionality of a portion of the light with the common general output direction, the light output distribution for the lighting device may be increased. By reflecting light, the light output distribution may be increased to cover at least a portion of a second half-sphere in the opposite direction with respect to the substrate, for a more omnidirectional light distribution. Thus, the lighting device may illuminate opposite directions with respect to the substrate while having light sources arranged on only one side of the substrate.

Preferably, the portion of the light that is reflected by the first optical elements towards the second portion of the housing is between 30% and 70% of the total light emitted by the plurality of light sources. So, a substantial part of the light is reflected and exits the lighting device via the second portion of the housing, therewith enabling a more balanced light output for realizing a more omnidirectional light distribution. An even more uniform light distribution can be realized by having substantially the same portion of light exiting via the first portion of the housing and via the second portion of the housing. This is the case when about 50% of the light generated by the plurality of light sources is reflected by the plurality of first optical elements.

According to an embodiment of the present invention, the substrate may at least partly comprise a light transmissive material arranged to transmit light reflected from the first optical elements towards the second portion of the housing. The light transmissive substrate may allow reflected light to reach the second portion of the housing. The light transmissive material may for example be transparent or translucent.

According to an embodiment of the invention, the substrate may comprise at least one through-hole for transmitting, at least partly, light reflected from the first optical elements towards the second portion of the housing. The substrate may be arranged with through-holes to allow reflected light to reach the second portion of the housing.

According to an embodiment of the invention, the second side of the substrate may be attached along the second portion of the housing. By attaching the substrate with the housing, a more compact and space-efficient lighting device may be provided.

According to an embodiment of the invention, the plurality of the first optical elements may be arranged to refract light transmitted through the first optical elements providing an increased angular spread. By refracting the light exiting the first optical elements further manipulation of light may be allowed such that a desired light output distribution is provided for a first light output distribution. The first light output distribution corresponds to the light transmitted through the first optical element and the first portion of the housing. Through refraction the shape and form of the first light distribution may be adapted based on predetermined requirements.

According to an embodiment of the invention, a plurality of second optical elements may be arranged along the second portion of the housing and said plurality of second optical elements may be arranged to refract the reflected light providing an increased angular spread. By providing the plurality of second optical elements the angular spread may be increased for a second light output distribution in the opposite direction of the first light output distribution. The second light output distribution corresponds to the light transmitted through the second portion of the housing. Thus, by providing a refracting effect for both the first optical element and the second optical element, the evenness and shape of the light output distribution may be improved.

According to an embodiment of the invention, the plurality of first optical elements may be arranged to reflect part of the light emitted by the plurality of light sources in a direction adjacent to each light source towards the second portion of the housing. The reflective portion of the first optical elements may, preferably, have a protruding shape such that incoming light is reflected with an angle adjacent to the light sources to avoid losses of light due to that light is reflected back to the light sources. The protruding shape may protrude in the direction of the light sources. The shape of the reflective protruding shape may for example be a triangle, a half-sphere, elliptical, u-shaped, etc. Other shapes are also conceivable that allows for reflection toward the sides of each light source.

According to an embodiment of the invention, each of the first optical elements may comprise a mirror and a lens on each side of the mirror, the lenses may be arranged to spread out light transmitted through the first optical elements. Optical components may be utilized to create a first optical element and lighting device.

According to an embodiment of the invention, the plurality of first optical elements may comprise a coating arranged to partly reflect and partly transmit light. The coating may provide simple productions steps. Furthermore, by providing a coating the transmittance may gradually increase with an increasing angle from the centre of the first optical elements. The intensity of the emitted light may be greatest in proximity at a centre of emission, and may diminish with an increasing angle from this centre of emission. Therefore, it may be advantageous that the reflectance is highest in an area of each first optical element where the intensity of light is highest, at the centre of each first optical element, and decreases with increasing angles around this point. By gradually defining the reflectance, a more even and smooth light output distribution may be perceived.

According to an embodiment of the invention, the light transmissive material may comprise particles for scattering and/or converting a wavelength of light emitted by the light sources.

According to an embodiment of the invention, the lighting device may comprise an electrical connector fitting arranged for providing voltage or power to said plurality of light sources from an external power source and the electrical connector fitting may be attached to one end of the housing. The electrical connector fitting may be a retrofit fitting, like for instance the well-known E14, E26 or E27 screw fitting, or a bayonet type of fitting.

According to an embodiment of the invention, the light sources may be electrically connected to an electric circuit arranged to control the voltage provided to the light sources. The electric circuit may, preferably, be driver components such as a driver unit or a driver circuit for driving the light sources. The electric circuit may be adapted to modify at least one parameter of the light emitted from the light sources. The electric circuit may, for example, by controlling the voltage provided to the light sources, modify the intensity of light. Furthermore, the electric circuit may control the number of light sources that emit light and the intensity of light emitted from each of the light sources. In some embodiments the driver may be electrically connected to the electrical connector fitting.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The aspect of the invention, including its particular features and advantages, will be readily understood from the following detailed description and the accompanying drawings, in which.

DETAILED DESCRIPTION

Figure 1:
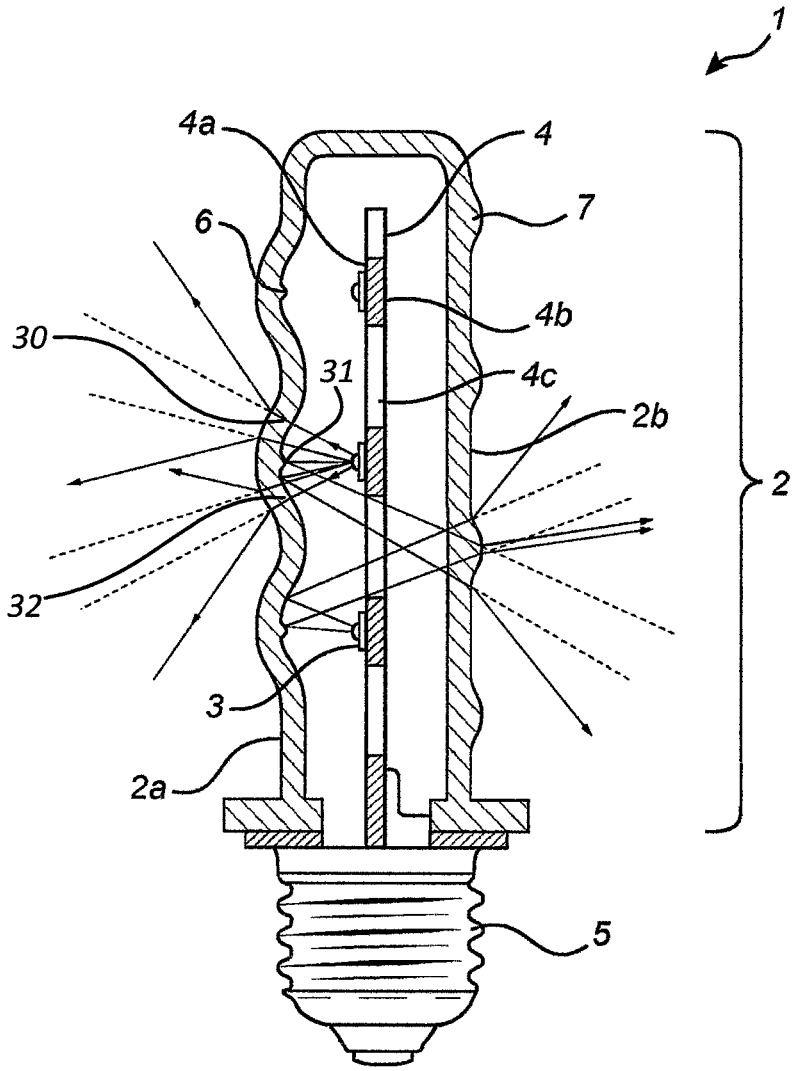
FIG. 1 illustrates a cross-sectional side view of the lighting device according to an example embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

Referring now to the drawings and to FIG. 1 in particular, there is depicted a cross-sectional side view of the lighting device 1 comprising a housing 2 surrounding a plurality of light sources 3 arranged on a substrate 4 and an end of the housing 2 is attached to a electrical connector fitting 5 in this case a standard threaded fitting. The lighting device 1 is, in FIG. 1, arranged for retrofit fittings, i.e. to fit in a luminaire initially designed for a conventional lighting device, such as a light bulb. However, other electrical connector fittings are conceivable such as a bayonet fitting, a clamp fitting, a plug fitting, or any fitting conceivable for luminaires.

As is illustrated in FIG. 1, the plurality of light sources 3, here three light emitting diodes, are mounted on the substrate 4 such as a PCB on a first surface 4*a*, such that each of the light sources 3 face the same direction and have a common general output direction. The substrate 4 is substantially parallel to the fastening means axis, in this embodiment a rotational axis centered around the electrical connector fitting 5.

The light sources 3 are facing a first portion 2*a* of the housing 2 having a first optical element 6 arranged opposite each light source 3. Each of the first optical elements 6 arranged in the first portion 2*a* of the housing 2 is a combination of a reflector and a transmitter configured to both reflect and transmit light from the light sources 3. The housing 2 may comprise a light transmissive material arranged to scatter and diffuse light exiting the housing 2. The housing 2 has a second portion 2*b* generally opposite the first portion 2*a* with respect to the substrate 4. A plurality of second optical elements 7 are arranged from the electrical connector fitting 5 to the top along the second portion 2*b*. The first optical elements 6 in FIG. 1 have protruding portions arranged to reflect light at one or both sides of each light source 3 towards the second optical elements 7 arranged on either side of the light source 3. The second optical elements 7 are preferably arranged in the same elevation as the through-holes 4*c*, i.e. in between the light sources 3.

To provide the inclined reflection the reflective portion of the first optical element 5 may have protruding shapes such as a triangular shape, half-spherical shape, however, other shapes may also be conceivable that provides an angle to reflect the light at the side each light source 3. The plurality of first optical elements 6 may comprise a reflective coating. The reflective coating may be arranged such that a portion of the light is reflected while the rest is transmitted through the first optical element 6. The reflectivity may be graded such that one portion has a higher reflectivity than another to provide a desired light distribution. With reference to FIG. 1, the light reflected by the protruding portion of the first optical element 6 is directed at the sides of each light source 3 and passes the substrate 4 through through-holes or transmissive areas 4*c* towards the second portion 2*b* of the housing 2 arranged substantially opposite the first portion 2*a* of the housing 2, in particularly towards the second optical elements 7. As is illustrated in FIG. 1, the second optical elements 7 are lenses arranged to increase the angular spread the exiting light of the reflected light. By providing a lighting device 1 according to FIG. 1, a more omnidirectional light output distribution may be achieved.

In FIG. 1 schematic rays of light have been depicted to illustrate the light path through the lighting device 1 and describe the functionality of the first optical elements 6, the through-holes 4*c* and the second optical element 7. The light sources 3 mounted on the first side 4*a* of the substrate 4 emit light in the same direction toward the first optical elements 6, wherein the central output direction of the light sources 3 is generally perpendicular with respect the plane of the substrate 4. The central output direction of the light sources 3 is generally perpendicular to the axis of rotation for the fastening means, i.e. the electrical connector fitting 5. Light reaching the first optical elements 6 is either transmitted and refracted through the element or reflected. If light were transmitted through the first optical elements 6 without refraction, it would continue in the light output direction of the light when emitted by the light source 3, which is illustrated by the dashed line. However, since the first optical elements 6 in this embodiment comprises a lens 30, 32, such as a concave lens, and a mirror, the light exiting the element 6 is refracted and provides light in additional output directions when exiting the lighting device 1. For two light sources 3, two schematic light rays have been drawn for each of the two light sources, one light ray representing an incoming light ray at the centre of reflective portion 31 of the first optical elements 6, such as a mirror, and the other light ray representing the incoming light at the peripheral reflective portion of the first optical elements 6. Each of these light rays is transmitted through the through-holes 4*c* towards the second optical elements 7 to be refracted and increase the light output distribution for the reflected light. The dashed light continuing from the reflected light in the surrounding represents the rays if light were not refracted by the second optical elements 7.

Figure 2:
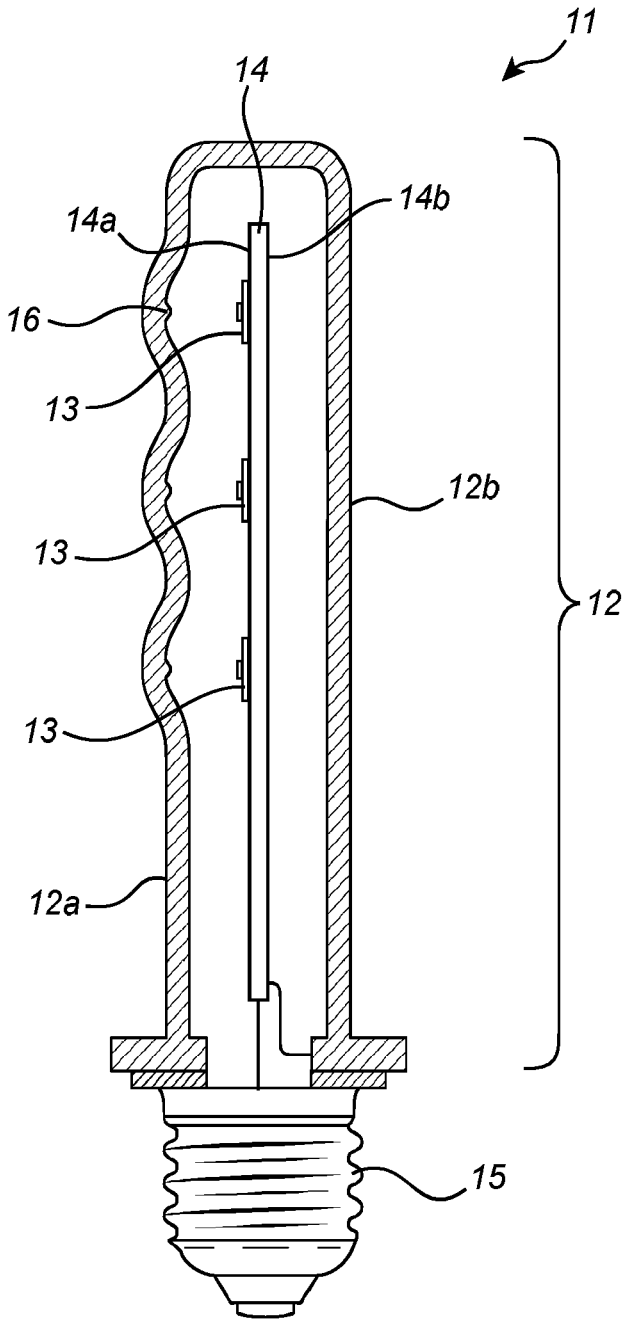
FIG. 2 shows a cross-sectional side view of the lighting device according to an example embodiment.

With reference is now made to FIG. 2, depicting a cross-sectional side view of a lighting device 11 as described in FIG. 1, but in this case without any second optical elements to increase the angular spread from light exiting the second portion 12*b* of the housing 12 and the substrate 14 comprises a transmissive material 14*c* according to an embodiment of the invention. The first portion 12*a* of the housing 12 with the first optical elements 16 is arranged as described in FIG. 1, however, the light sources 13 are mounted on a light transmissive substrate 14, such as a light transmissive PCB.

The substrate 14 is generally arranged to transmit visible wavelengths of light. Light reflected from the first optical element 16 may thus be transmitted though the transmissive material towards the second portion 12*b* of the housing 12. The second portion 12*b* of the housing 12, arranged along the opposite side of the first portion 12*a* of the housing 12 having the first optical elements 16, may comprise scattering particles, such as high scattering non-absorbing particles, such as for example $TiO_2$, $Al_2O_3$ or $SiO_2$. Scattering particles in the housing 13 may diffuse exiting light providing a softer and more evenly distributed light output distribution. The scattering particles may be integrated in a sheet, or be added in several layers allowing diffusivity.

In addition, the housing 12 and in particular the first optical elements 16 and first portion 12*a* of the housing 12 may comprise scattering particles, such as for example $TiO_2$, $Al_2O_3$ or $SiO_2$. The transmittance is determined by the amount of light being transmitted through a material compared to the amount of incoming light. The amount of scattering particles may determine the amount of light being transmitted and how much light is reflected back. Increasing amounts of scatterers may decrease the transmittance. For some embodiments the first optical element 16 may thus be integrated in the housing 12. The thickness of the scattering particles may determined the reflectance and transmittance. The diffusing portion may be integrated in a sheet, or be added in several layers allowing diffusivity. Variations in thickness or concentration of scattering particles may thus provide a varied reflectance magnitude over each of the first optical elements 6.

Figure 3:
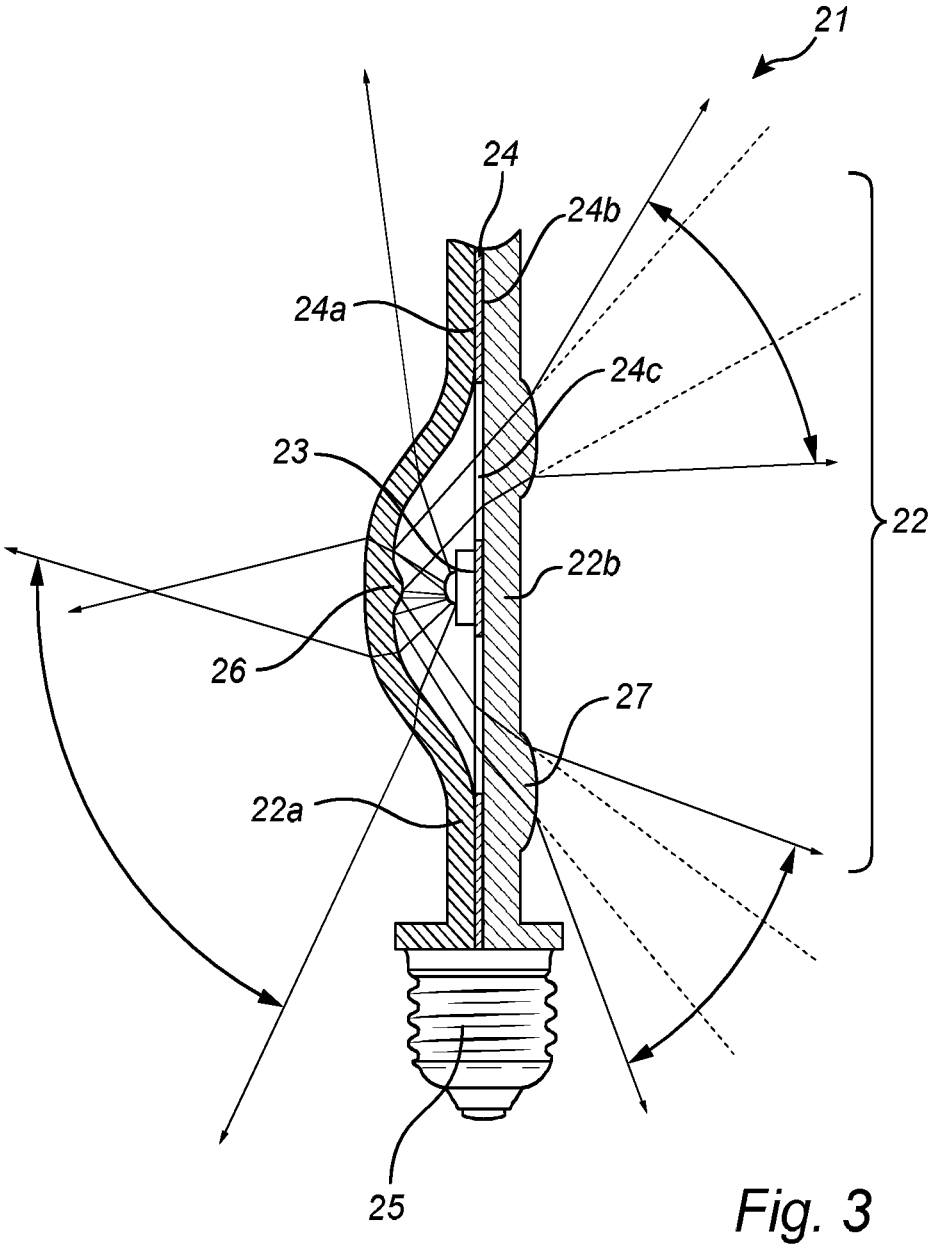
FIG. 3 illustrates a cutout of a cross-sectional side view of the lighting device according an example embodiment of the present invention.

With reference to FIG. 3, a cut-out cross-sectional side view of a lighting device 21 is illustrated according to an embodiment of the present invention. The cross-sectional cut-out side view of the lighting device 21 depicts a portion of a compact lighting device having a electric connector fitting 25. The lighting device 21 provides a compact lighting device by providing a substrate 24 having a plurality of light sources 23 mounted on a first side 24*a* while the opposite side, a second side 24*b* of the substrate, is attached along the inner side of second portion 22*b* of the housing 22 from the base 25 of the lighting device to the peripheral part of the housing 22. In addition, parts of the first portion 22*a* of the housing 22 may be attached to the first substrate side 24*a* to further provide a compact lighting device 21.

The substrate 24 is arranged with through-holes 24*c* such that reflected light may be transmitted from the first optical elements 26 towards the second portion 22*b* of the housing 22, in particular towards the second optical elements 27. By placing the housing 22 in connection with the substrate 24 a compact lighting device 21 may be provided. The first optical element 26 is a combination of a reflector and a lens in embodiment illustrated in FIG. 3.

With reference to FIG. 3, the central part of the first optical element 26 is arranged to reflect light while the peripheral part of the first optical elements 26 comprises a lens arranged to refract light to increase the angular spread, as is illustrated by the schematical light rays. The light exiting the first portion 22*a* of the housing 22 is refracted by the lens to increase the outputted light distribution. The schematical light rays describing the refracted light path is also illustrates in FIG. 3. Light emitted from the light sources 23 reaches the first optical elements 26 and is reflected towards through-holes 24*c* in the substrate 24. The reflected light passes the substrate 24 through the through-holes 24*c* and continues on towards the second portion 22*b* of the housing 22 to be transmitted and refracted through the second optical element 27 such that an increased output light distribution for light exiting the second portion 22*b* of the housing 22 is provided.

For some embodiments, as in FIG. 3, the first optical elements 26 and the second optical elements 27 may be integrated in the first portion 22*a* of the housing 22 and the second portion 22*b* of the housing 22, respectively.

The housing 2, 12, 22, first optical elements 6, 16, 26 and/or second optical element 7, 27 may comprise polymer material, e.g. polymethyl methacrylate, PMMA, or PC-poly carbonate. Alternatively, the housing 2, 12, 22 may be made of glass. The light sources 3, 13, 23 may include integrated optical elements, such as a lens to further guide the light towards the first optical elements 6, 16, 26 according to predetermined directions. The first optical elements 6, 16, 26 may in some embodiments be integrated in the first portion 2*a*, 12*a*, 22*a* of the housing 2, 12, 22, such that the first portion 6, 16, 26 may comprise a lens shape and a reflective portion, in this embodiment the reflective portion is arranged in the centre while the lens is provided in the peripheral portions of the first optical elements 6, 16, 26, however, the reverse is also conceivable. In addition, the first optical elements 6, 16, 26 may in some embodiments comprise a refractive lens having a refractive coating arranged to reflect a portion of the light. However, the first optical elements 6, 16, 26 may also be arranged between the first portion 2*a*, 12*a*, 22*a* of the housing 2, 12, 22 and the light sources 3, 13, 23, i.e. inside the housing 2, 12, 22.

The lighting device 1, 11, 21, may particularly be advantageous for retrofit fluorescent or solid state lighting or luminaires.

The term "first portion 2*a*, 12*a*, 22*a* of the housing 2, 12, 22 may generally be interpreted as a side along the housing 2, 12, 22 projecting from the fitting towards the end of the protruding housing 2, 12, 22, covering at most a portion of the housing arranged in front of the light sources 3, 13, 23 in the light output direction of the light sources 3, 13, 23. The term "second portion 2*b*, 12*b*, 22*b* of the housing 2, 12, 22 may generally be interpreted as a side along the housing 2, 12, 22 projecting from the base towards the end of the protruding housing opposite the first portion 2*a*, 12*a*, 22*a* of the housing. The second portion 2*b*, 12*b*, 22*b* of the housing covers at most a portion of the housing arranged in behind of the light sources 3, 13, 23, thus the opposite direction of the light output direction of the light sources 3, 13, 23.

A driver unit or a driver circuit (not shown in the figures), for driving the light sources, may be arranged on the substrate 4, 14, 24. The driver unit and/or driver circuit may be adapted to modify at least one parameter of the light emitted from the light sources, such as the intensity of light. The driver circuit controls a current and voltage to the light sources. The driver circuit and/or driver unit is further electrically connected to the electrical connector fitting. The driver electronic may be arranged on the substrate.

Even though the invention has been described with reference to specific embodiments thereof, many different alterations, modifications and the like will become apparent for those skilled in the art. For example, in some embodiments the reflective portion of the first optical element 6, 16, 26 may be arranged in the peripheral portions of the element 6, 16, 26, while the transmitting portion is arranged in the centre of the first optical element 6, 16, 26. Parts of the system may be omitted, interchanged or arranged in various ways, the system may yet being able to perform the method of the present invention. The lighting device does not need to have a retrofit fitting as illustrated in FIG. 1-3, the lighting device may be integrated in any type of luminaire, such as pendant luminaires, outdoor city beautification luminaires, corridor lighting and other flat luminaires that benefit from an omnidirectional light distribution.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. A lighting device comprising:

a substrate having a first side and a second side;

a plurality of light sources arranged on the first side of the substrate, said light sources having a common general output direction, a housing of a light transmissive material surrounding said substrate is arranged to transmit light, the housing having a first portion and a second portion, wherein the second portion is arranged substantially opposite the first portion with respect to said substrate;

a plurality of first optical elements arranged substantially opposite the output direction of said plurality of light sources along the first portion of the housing facing the first side of the substrate, wherein at least a portion of said substrate is adapted to allow transmission of light, wherein each of said plurality of first optical elements comprise a mirror and a lens on each side of the mirror, said lenses are arranged for providing an increased angular spread through refraction for light transmitted through the lenses, wherein said mirror comprises a surface that is convex with respect to the plurality of light sources, wherein the lenses are arranged to transmit part of the light emitted by said light sources and wherein said surface of the mirror is configured to reflect part of the light emitted by said light sources through said substrate towards the second portion of the housing to increase a light output distribution effect by also outputting light opposite the common general output direction of the light sources.

2. The lighting device according to claim 1, wherein the portion of the light that is reflected by the first optical elements towards the second portion of the housing is between 30% and 70% of the total light emitted by the plurality of light sources.

3. The lighting device according to claim 1, wherein said substrate comprises at least partly a light transmissive material arranged to transmit light reflected from the first optical elements towards the second portion of the housing.

4. The lighting device according to claim 1, wherein said substrate comprises at least one through-hole for transmitting, at least partly, light reflected from the first optical elements towards the second portion of the housing.

5. The lighting device according to claim 1, wherein said second side of said substrate is attached along the second portion of the housing.

6. The lighting device according to claim 1, wherein a plurality second optical element is arranged along the second portion of the housing and said plurality of second optical elements is arranged to refract the reflected light providing an increased angular spread.

7. The lighting device according to claim 1, wherein said plurality of first optical elements is arranged to reflect part of the light emitted by said plurality of light sources in a direction adjacent to each light source towards the second portion of the housing.

8. The lighting device according to claim 1, wherein the plurality of first optical elements comprise a coating arranged to partly reflect and partly transmit light.

9. The lighting device according to claim 1, wherein the light transmissive material comprises particles for scattering and/or converting a wavelength of light emitted by the light sources.

10. The lighting device according to claim 1, wherein the light sources are electrically connected to an electric circuit arranged to control the voltage or the power provided to the light sources.

11. The lighting device according to claim 1, wherein the lighting device comprises an electrical connector fitting configured to provide voltage to said plurality of light sources from an external power source, the electrical connector fitting being attached to one end of the housing.

12. The lighting device according to claim 11, wherein the electrical connector fitting is a retrofit fitting.

13. The lighting device according to claim 11, wherein the substrate is parallel to a rotational axis of the electrical connector fitting, and/or wherein a central output direction of the light sources is perpendicular to the axis of rotation for the electrical connector fitting.

14. The lighting device according to claim 1, wherein the light sources are light emitting diodes.

15. The lighting device according to claim 1, wherein a coating is formed at least in part between said mirror and at least one of the lenses, wherein the coating is configured to partly reflect and partly transmit light, and wherein a reflectivity of the coating between said mirror and said at least one of the lenses decreases with increasing distance from the mirror.

* * * * *